US005879455A

United States Patent [19]

Stahlecker

[11] Patent Number: 5,879,455

[45] Date of Patent: Mar. 9, 1999

[54] DEVICE FOR PARAFFIN WAXING A RUNNING YARN

[75] Inventor: Fritz Stahlecker, Josef-Neidhart-Strasse 18, 73337 Bad Überkingen, Germany

[73] Assignees: Fritz Stahlecker, Bad Ueberkingen; Hans Stahlecker, Suessen, both of Germany

[21] Appl. No.: 724,895

[22] Filed: Oct. 3, 1996

[30] Foreign Application Priority Data

Oct. 20, 1995 [DE] Germany ..... 195 39 099.7

[51] Int. Cl.[6] ..... B05C 11/00

[52] U.S. Cl. ..... 118/78; 118/76; 118/78; 118/DIG. 22; 427/2.29; 427/11; 28/172.1; 28/217; 57/7; 57/10; 57/20

[58] Field of Search ..... 118/76, 78, DIG. 22; 427/2.29, 11; 28/172.1, 217; 57/7, 10, 20

[56] References Cited

U.S. PATENT DOCUMENTS 1,528,527 3/1925 Campbell ..... 118/78
4,345,542 8/1982 Hauner ..... 118/78
5,624,494 4/1997 Schmolke et al. ..... 118/78

FOREIGN PATENT DOCUMENTS 40 10 469 A1 10/1991 Germany .
4010469 10/1991 Germany .

*Primary Examiner*—Peter Chin
*Assistant Examiner*—Michael P. Colaianni
*Attorney, Agent, or Firm*—Evenson, McKeown, Edwards & Lenahan, P.L.L.C.

[57] ABSTRACT

In the case of a paraffin waxing device for a travelling yarn, a rotating paraffin body is weighted in axial direction against a stopping face. The stopping face lies against the front surface of the paraffin body, over which the travelling yarn is guided. During the waxing process, undesired rubbing off of paraffin particles can soil the feed material or the machine elements. According to the invention, the stopping face is rolled on the rotating front surface. The rubbing-off of paraffin particles, in particular in the area of the stopping face, is hereby avoided.

22 Claims, 6 Drawing Sheets

DEVICE FOR PARAFFIN WAXING A RUNNING YARN

BACKGROUND AND SUMMARY OF THE INVENTION

The present invention relates to a device for paraffin waxing a travelling yarn, comprising a rotating paraffin body which is weighted in axial direction against a stopping face, which stopping face lies against a front surface of the paraffin body over which the travelling yarn is guided.

A paraffin waxing device is known from German published patent application 40 10 469 A1, in the case of which a rotating paraffin body with a front surface is pressed against the front ends of three pin-like spacer supports. These spacer supports are fixed, stationary, to a base plate, and their front surfaces serve as stopping faces for the axially loaded paraffin body. In particular because of the sliding of the paraffin body on the spacer supports, paraffin particles are rubbed off at the front ends. These particles can soil the feed material or the machine elements.

It is an object of the present invention, in the case of a paraffin waxing device, to avoid the rubbing-off of paraffin particles as far as possible.

The object has been achieved in accordance with the present invention in that the stopping face can be rolled on the rotating front surface.

As a result of the arrangement and construction of the stopping face according to the present invention, it is avoided that the paraffin body slides on the stopping face. Thus, paraffin particles are not, or not in any great amount, rubbed off in the area of the stopping face. Rather, paraffin is released where it should be released, namely on the travel of the yarn on the front surface of the paraffin body. The paraffin released by the relative movement between the paraffin body and the yarn remains on the yarn and eases its further processing.

The undesirable sliding of the paraffin body on the stopping face is avoided in that the stopping surface does not remain still in relation to the paraffin body, but rather moves with it. The stopping face can be moved with the rotating front surface in various ways. It is, for example, possible to arrange the stopping face in such a way that it is guided by the front surface of the paraffin body. The stopping face can hereby be arranged at the surface of a movably supported roller body. When the roller body moves, the stopping face rolls on the rotating front surface of the paraffin body. The stopping face is formed by the respective adjacent-lying point of the surface of the roller body during the rolling movement. Various types of bodies, with which a rolling movement on the front surface of the paraffin body is possible, can be used as a roller body.

In an advantageous development, the stopping face is arranged at the circumferential side of at least one rotatable roller or disc.

The roller or disc is supported in such a way that its circumferential side is disposed against the front surface of the paraffin body and by means thereof is set to rotate, whereby it rolls on the front surface.

In another advantageous embodiment, the stopping face is arranged at the front side of at least one rotatable disc. It is hereby possible to curve the change-over area from front side to circumferential side, and to arrange the disc in such a way that the above mentioned curved area rolls on the front surface of the paraffin body. The stopping face lies then in the change-over area from front side to circumferential side of the disc, whereby the rolling movements are similar to those when a rotatable roller is used. In another advantageous embodiment the stopping face is arranged to the surface of at least one rotatable ball.

In an advantageous embodiment the stopping surface is supported in such a way that it can be swivelled away from the paraffin body. Here, the roller body, on whose surface the stopping face is arranged, is supported by a holder which is in turn pivotably arranged.

In a further embodiment, the paraffin body and/or the stopping surface are vibration-damped. When in operation, vibrations, which arise inside the paraffin waxing device or which are transferred from outside to the paraffin waxing device, can cause paraffin particles to come off. This transmission of vibrations can occur for example when the paraffin waxing device is arranged to the frame of a machine which comprises a winding device, in particular a winder machine or a spinning machine. By means of a vibration damper, such vibrations or knocks could be weakened to such a degree that paraffin particles would not come off.

It is advantageously possible to make the stopping face from vibration-damping material.

It is further advantageously possible, to secure the stopping face by means of a holder which comprises vibration-damping means. It is, for example, thus possible to use an intermediary part made of vibration-damping material. The intermediary part could be arranged between a stable element of the holder and a stable machine element to which the holder is secured.

The vibration damper can be advantageously so formed that the paraffin body is secured by means of a holder which comprises vibration damping means. An intermediary part, made of vibration damping material, can also be used here, which can be arranged, for example, between a stable element of the holder and a stable machine element to which the holder is secured.

These and further objects, features and advantages of the present invention will become more readily apparent from the following detailed description thereof when taken in conjunction with the accompanying drawings.

DETAILED DESCRIPTION OF THE DRAWINGS

Figure 1:
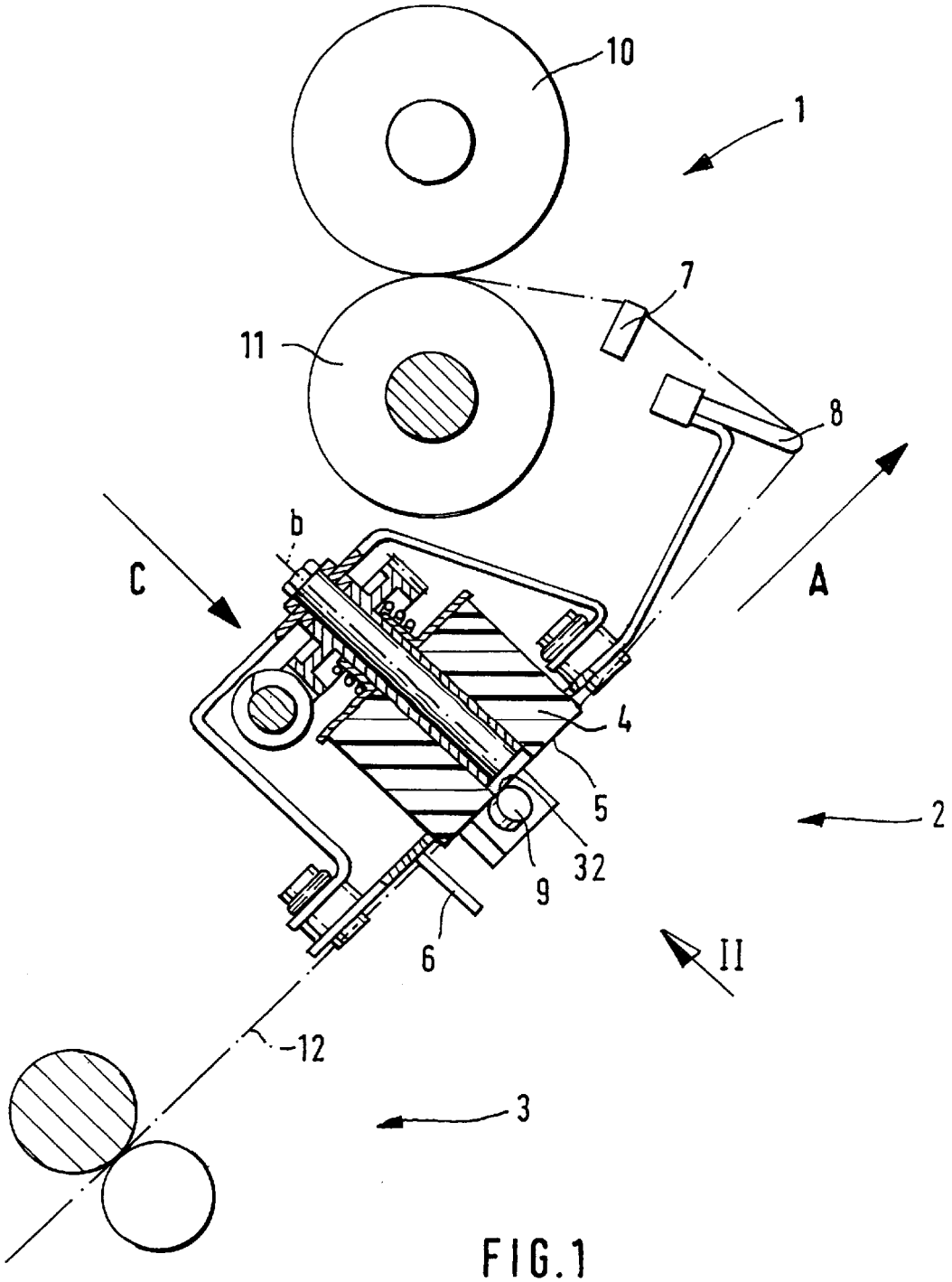
FIG. 1 is a partly sectional side view of a first embodiment of a paraffin waxing device which is arranged at a winding device and constructed according to a first preferred embodiment of the present invention.

The paraffin waxing device 2 shown in FIG. 1 is arranged on a spinning unit on an open-end rotor spinning machine (not shown). The paraffin waxing device 2 is arranged downstream of an opened rotor spinning device in the direction A of a yarn denoted by a dot-dash line and arranged upstream of a winding device 1. The yarn 12, drawn off by means of a delivery device 3 from the open-end rotor spinning device is guided over a paraffin body 4 of the paraffin waxing device 2 to the winding device 1, where it is wound onto a winding package 10 driven by a drive roller 11.

When travelling through the paraffin waxing device 2, the yarn 12 is at first guided through a stationary yarn guide 6 and then over the front surface 5 of the rotating paraffin body 4.

When crossing the front surface 5 the yarn 12 is deflected by a tiny amount from its straight path so that it lies continuously against the paraffin body 4 and takes the necessary amount of paraffin with it. The paraffined yarn 12 travels over a deflector loop 8 through a traversing yarn guide 7, which effects the distribution of the yarn 12 in the direction of the winder package 10.

Because of the continuous rubbing-off of paraffin by the yarn 12, the rotating paraffin body 4 gradually wears out, whereby its axial length diminishes. It is therefore necessary to slide the paraffin body 4 continuously in axial direction in the path of the yarn 12. For this purpose, the paraffin body 4 is weighted in arrow direction C, whereby the front side 5 is disposed continuously against a stopping face 32, which is arranged on the surface of a rotatably mounted roller body. In the first embodiment shown in FIGS. 1 to 6, the roller body hereby takes the form of a rotatable roller 9, on whose circumferential side the stopping face 32 is arranged As can be seen in particular from FIG. 2, the roller 9 is arranged at a holder 14, which is secured in a non-movable way to a support 13. A further roller 9' is positioned to engage the paraffin body 4, which roller 9' is arranged at a holder 14' in the same way. During the continuous rotating of the paraffin body 4 in the rotational direction of the arrow D, the rollers 9 and 9', rotatably supported on the holders 14,14', roll on the front side 5 of the paraffin body 4. The holders 14 and 14', together with the rollers 9,9' are, when in operation, arranged in such a way that the axes a,a' of the rollers 9,9' cross the axis b of the cylindrical paraffin body 4.

Figure 2:
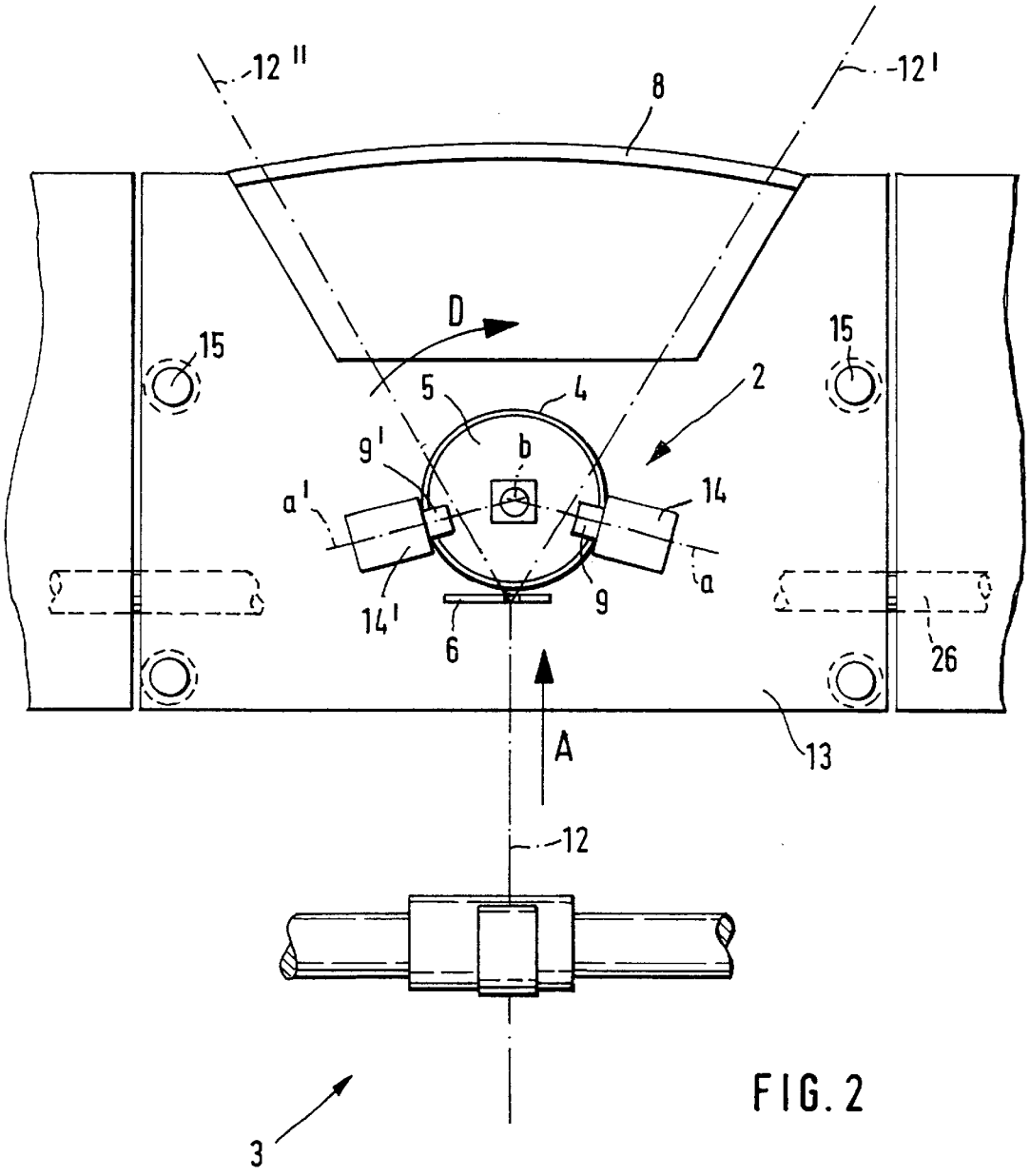
FIG. 2 is a view of the paraffin waxing device of FIG. 1 in the arrow direction II of FIG. 1.

Because of the traverse motion given by the yarn guide 7 (not shown in FIG. 2 ), the yarn 12 is constantly moved backwards and forwards over the front surface 5, whereby in FIG. 2 two extreme positions 12' and 12" of the yarn 12 are shown. In all traverse motion positions of the yarn 12, the paraffin body 4 moves diagonally to the travel path A of the yarn 12, so that a desired amount of paraffin is rubbed off from the paraffin body 4 and is taken along by the yarn 12. The paraffin body 4 wears off evenly over the entire front surface 5.

Figure 3:
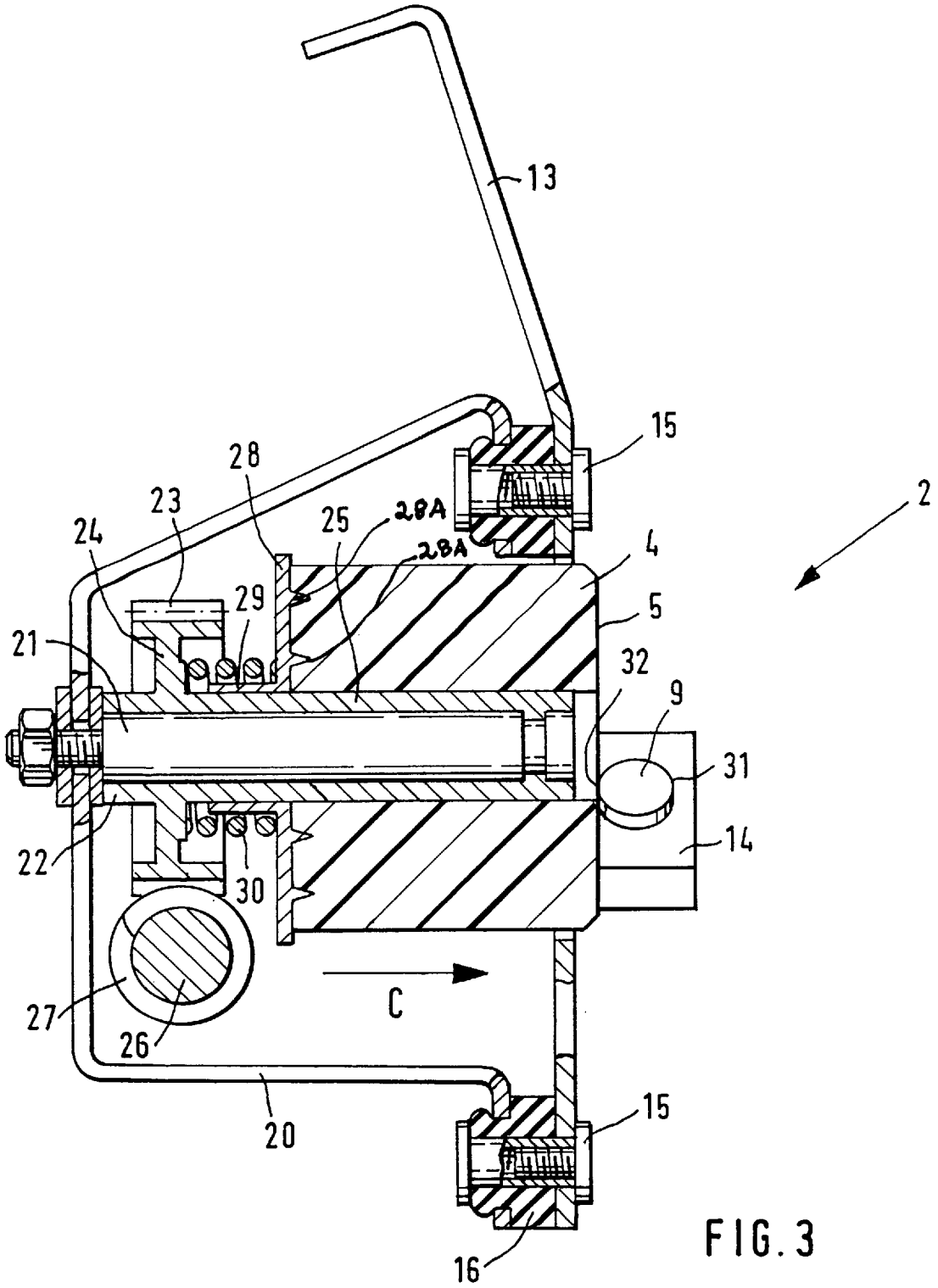
FIG. 3 is an enlarged view of the paraffin waxing device of FIG. 1 with a roller disposed on a paraffin body.

As can be seen from FIG. 3, the paraffin body 4 is provided with an axial bore hole, with which it is slidably arranged on a sliding section 25 of a drive part 22. The drive part 22, provided with an inner through bore hole, is rotatably mounted on a bearing bolt 21 and possesses a drive section 24. The drive section 24 comprises an external toothing 23, which is engaged with a worm thread 27 of a drive shaft 26. The drive part 22 is continuously rotated by the drive shaft 26 while the paraffin waxing device is in operation.

The sliding section 25 has an outer contour which is rectangular in cross section. There is a carrier 28 on the sliding section 25, which has a rectangular inner contour matching that of the above mentioned outer contour, and arranged slidably in axial direction. The carrier 28 projects with tips 28A into the relatively soft paraffin body 4, so that a taking-along connection between the carrier 28 and the paraffin body 4 is made. The paraffin body 4 is thus kept rotating constantly by means of the drive part 22 with the aid of the carrier 28.

A pressure spring 30 is arranged between the drive section 24 of the drive part 22 and the carrier 28, which spring weights the carrier 28 and the paraffin body 4 in axial direction of the arrow C. The front surface 5 of the paraffin body 4 hereby rests continuously against the stopping faces 32, which are formed by the circumferential sides 31 of the rotating rollers 9 and 9'. This will be described below.

The bearing bolt 21 is screwed onto a holder 20, which in turn is secured to the support 13. The support 13 is secured to the machine frame of the open-end spinning machine (not shown).

During spinning, vibrations are transmitted from the machine frame to the support 13. The further transmission of such vibrations to the paraffin waxing device 2 is avoided in that the holder 20 is secured to the support 13 in a vibration-dampened way. In the area of threaded screws 15, which create the connection between the holder 20 and the support 13, vibration dampers 16, made from a suitable material such as rubber or plastic, are arranged between the holder 20 and the support 13.

Figure 4:
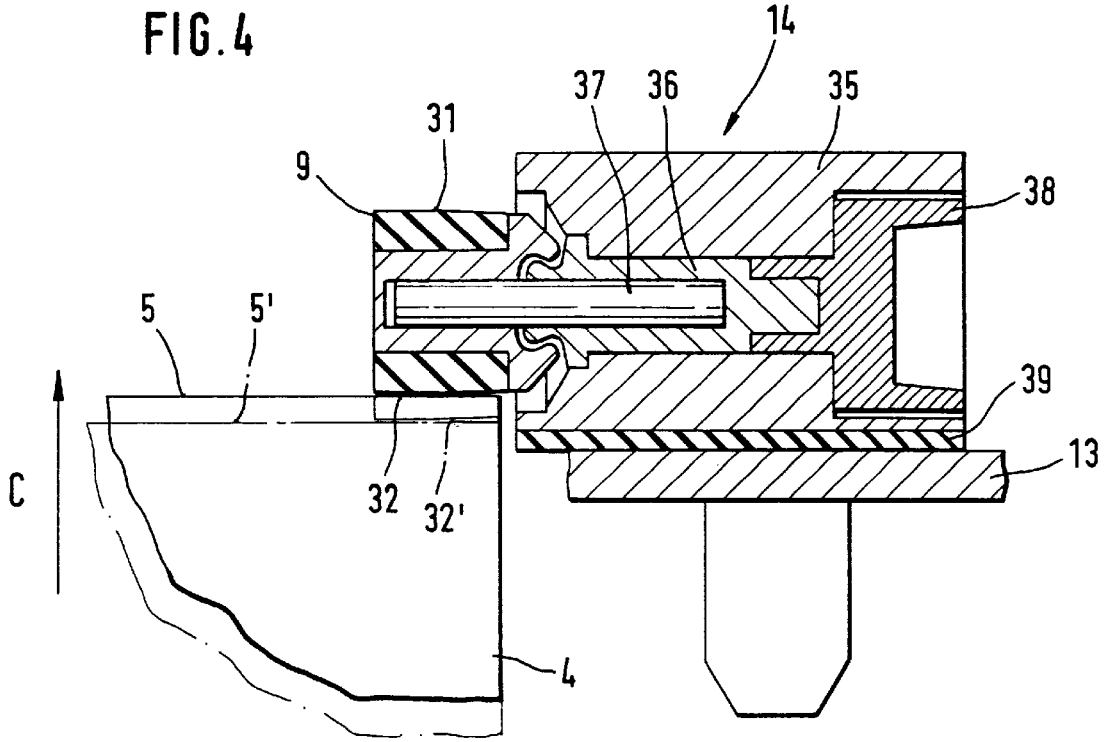
FIG. 4 is a longitudinal sectional view of the roller of FIG. 3.

As can been seen from FIG. 4, the holder 14 comprises a housing 35 for the roller 9 (as does the holder 14' for the roller 9'), in which housing further components for the bearing of the roller 9 are housed. The housing 35 is secured to the support 13 in a vibration-dampened way. A vibration damper 39 is arranged between the housing 35 and the support 13, which damper is made of a suitable material, for example rubber or plastic.

The housing 35 is provided with a cylindrical bore hole, in which a holder bush 36 is supported. An axle 37 is supported slightly eccentrically in the holder bush 36.

The roller 9 is slidably supported on the end area of the axle 37 facing away from the holder bush 36, so that it is capable of executing a rotational movement. The roller 9 is provided with a slightly crowned lining of a vibration-damping material, for example rubber or plastic.

As can be seen from FIG. 4, the paraffin body 4 is disposed with its front surface 5 against the stopping face 32 of the roller 9. As the roller 9 rolls on the rotating front surface 5 of the paraffin body 4, the stopping face 32 is formed by that part of the circumferential side 31 of the roller 9 disposed thereon during the rolling movement. Vibrations occurring in the support 13 are absorbed by the vibration damper 39 and the lining of the roller 9, so that vibrations, which could lead to a coming-off of paraffin particles at the stopping face, do not occur.

The position of the paraffin body 4 in relation to the travel path of the yarn 12 (not shown) in FIG. 4 (see FIG. 1) can be adjusted in that the position of the roller 9 is adjusted. Such a change in position of the paraffin body 4 can be practical in order to deflect the yarn to a lesser or increased degree from its path over the front surface 5 of the paraffin body 4 so that the pressure of the yarn 12 on the paraffin body 4 can be lessened or increased. The amount of paraffin rubbed off and taken along by the yarn 12 from the paraffin body 4 is dependent on the pressure of the yarn against the locating surface.

In order to adjust the position of the roller 9, the holder bush 36 can be turned inside the housing 35, and held in this turned position by a locking device (not shown). Due to the eccentric arrangement of the axle 37 in the holder bush 36, turning the holder bush 36 results in the axle 37 of the roller 9—according to rotational direction—being displaced in arrow direction C or in the opposite direction.

In FIG. 4, the displaced position 32' of the stopping face 32 of the roller 9 is shown by dot-dash lines. By displacing the stopping surface 32 into the position 32', the front surface 5 of the paraffin body 4 is displaced in the opposite direction of the arrow C into the position 5'. In this position 5', the deflection of the yarn 12 (see FIG. 1) is less extreme than in the position of the front surface 5, shown by continuous lines, so that the rubbing-off of paraffin by the travelling yarn 12 is not so extreme.

Figure 5:
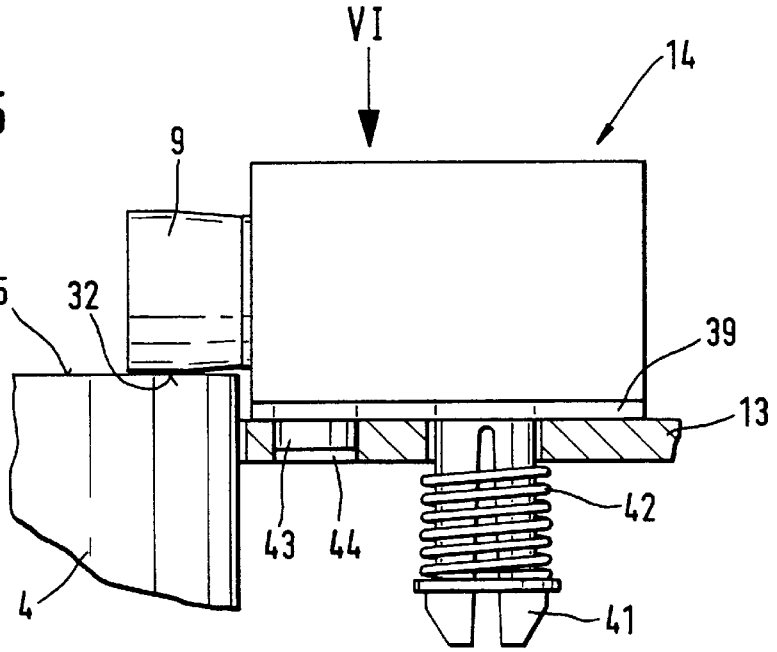
FIG. 5 is a side view of the roller of FIG. 3 with a swivelling device.
Figure 6:
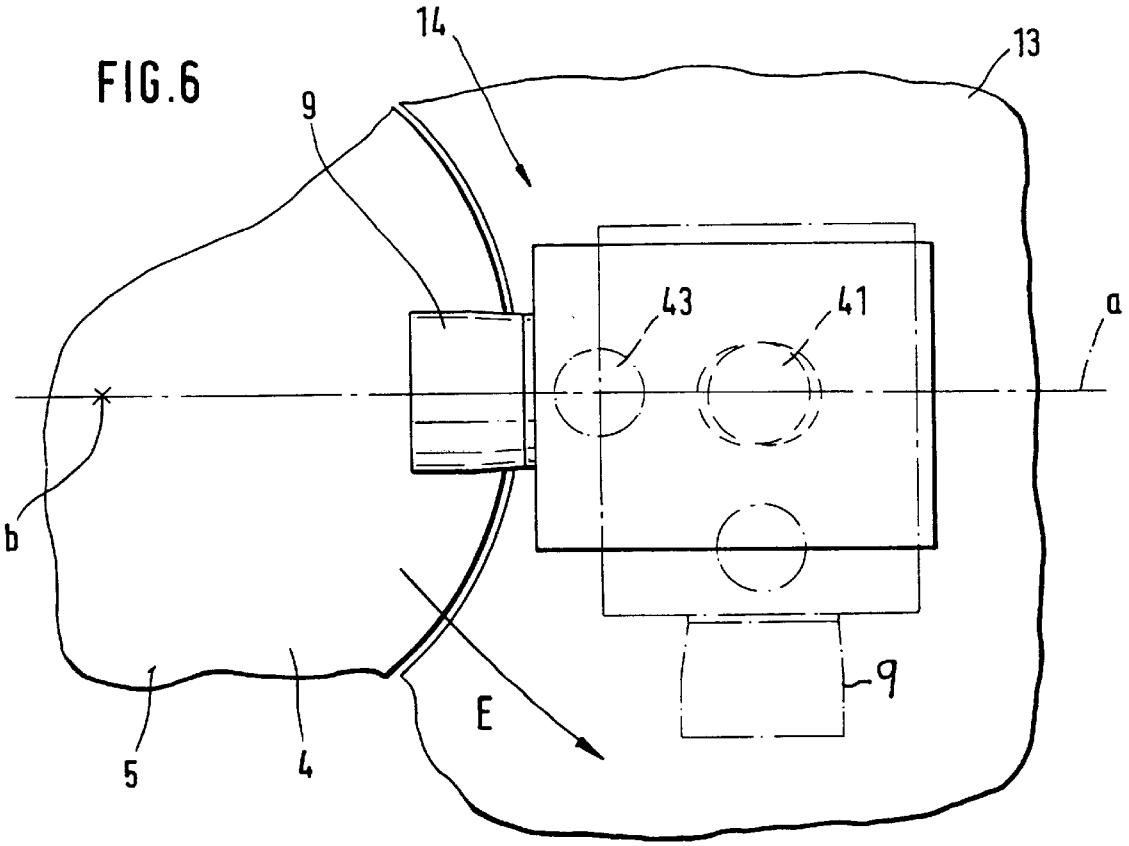
FIG. 6 is a view of the roller of FIG. 5 taken in arrow direction VI of FIG. 5, whereby the roller is shown in an operating and a swivelled position.

As can be seen from FIGS. 5 and 6, the roller 9 is arranged in such a way that it can be swivelled away from the sphere of influence of the paraffin body 4. Such a swivel action may be necessary in order to exchange the roller 9 for another one or to exchange a used-up paraffin body 4 for a new one.

In order to permit this swivel movement, the holder 14 is provided with an expanded bolt 41, which projects through a bore hole in the support 13 and which is surrounded by a pressure spring 42 in the form of a helical spring. The pressure spring 42 is supported against a radial stopper of the expanded bolt 41 and against the surface of the support 13 facing away from the holder 14, so that the holder 14 is pressed against the support 13 and can be raised by it against the force of the pressure spring 42.

The holder 14 comprises further a projecting pivot 43, which has dimensions which allow it to be guided into a bore hole 44 of the support 13 where it fits exactly.

When in operation, the holder 14, together with the roller 9, takes up the position shown in FIG. 6 by a continuous line. The axis a of the roller 9 crosses the axis b of the paraffin body 4.

In order to swivel the holder 14 out of the sphere of influence of the paraffin body 4, the holder 14 is first raised so far from the support 13 that the pivot 43 is raised out of the bore hole 44. Then the holder 14 is swivelled in arrow direction E, until it finally takes up the position shown in FIG. 6 by a dot-dash line. It is possible in this position to dismantle the roller 9 and, if the holder 14' is accordingly swivelled with the roller 9' (see FIG. 2), also the paraffin body 4.

Figure 7:
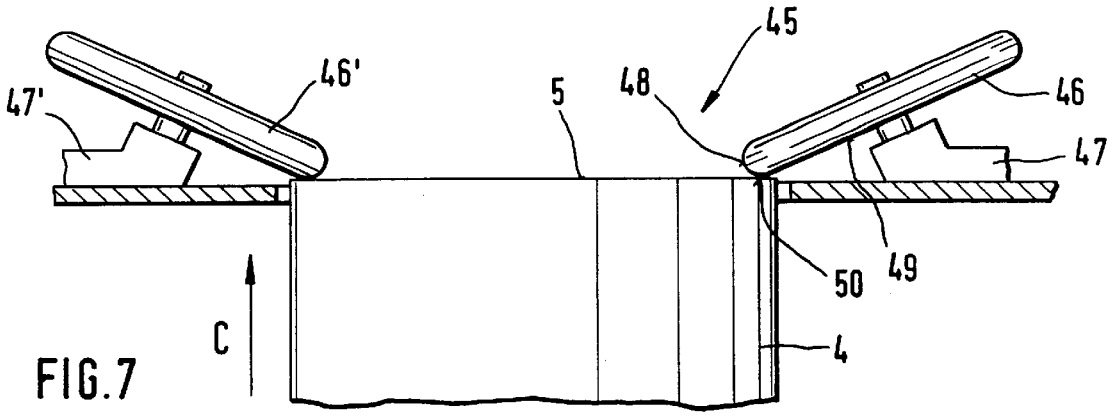
FIG. 7 is a partial view of a second embodiment of a paraffin waxing device.

In the second embodiment of a paraffin waxing device 45 shown in FIG. 7, a disc 46 is used as a roller body. The disc 46 is rotatably mounted in a holder 47. The circumferential side 48 of the disc 46 is convexly curved, whereby the area of the disc 46, in which the circumferential side 48 graduates into the front side 49, is also convexly curved. The disc 46 is arranged on the holder 47 in such a way that the change-over area, from the circumferential side 48 to the front side 49, is disposed against the front surface 5 of the paraffin body 4 and rolls on it. At the above mentioned change-over area, a stopping face 50 is formed at that part of the disc 46 which is disposed against the front surface 5 of the paraffin body 4 during the rolling movement. A further disc 46' is positioned to engage the paraffin body 4, which disc 46' is arranged at a holder 47' in the same way.

Figure 8:
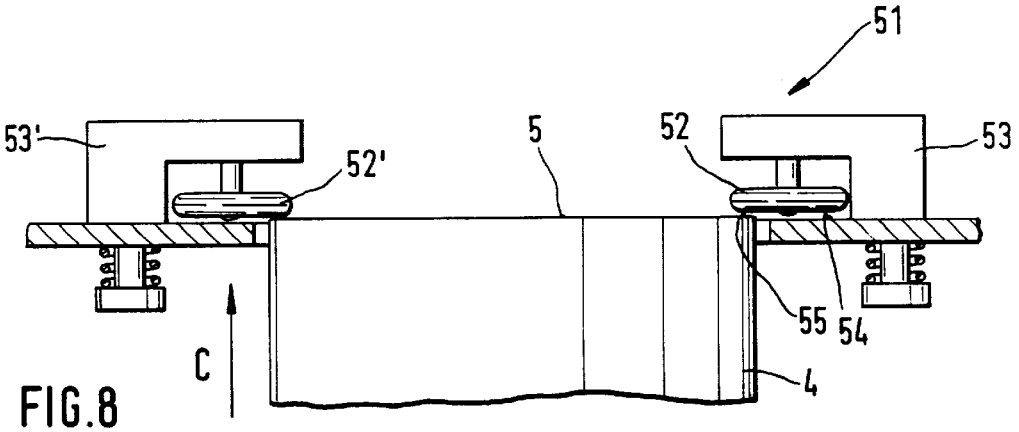
FIG. 8 is a partial view of a third embodiment of a paraffin waxing device similar to that in FIG. 7.

In the third embodiment of a paraffin waxing device 51 shown in FIG. 8, the roller body takes the form of a rotatable disc 52. The disc 52 is arranged at a holder 53 in such a way that a front side 54 of the disc 52 is disposed against the front surface 5 of the paraffin body 4 and rolls on it. Thus a stopping face 55 is formed by the front side 54 of the disc 52, which stopping face 55 lies on that part of the disc 52 which is disposed against the front surface 5 of the paraffin body 4 during the rolling movement. A further rotatable disc 52' is positioned to engage the paraffin body 4, which disc 52' is arranged at a holder 53' in the same way.

Figure 9:
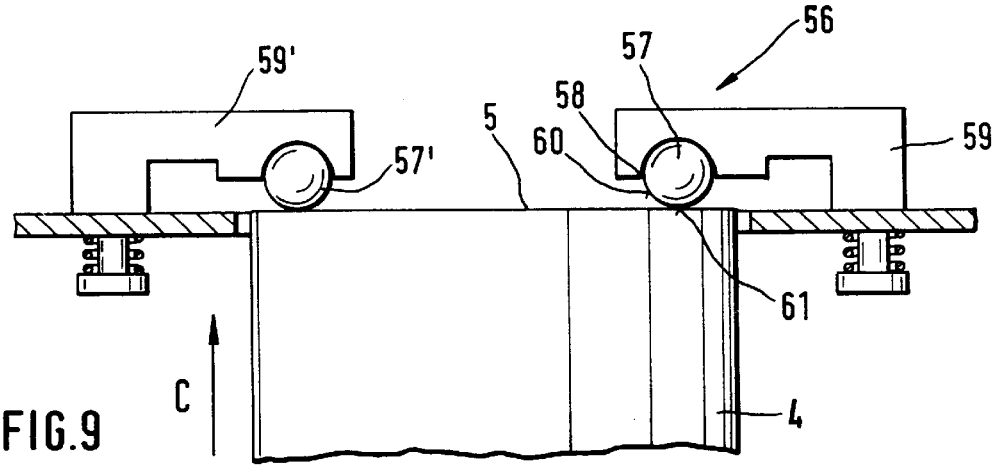
FIG. 9 is a partial view of a fourth embodiment of a paraffin waxing device similar to that in FIG. 7.

In the fourth embodiment of a paraffin waxing device 56 shown in FIG. 9, the roller body takes the form of a ball 57. The ball 57 is rotatably supported in a concave receiver 58 of a holder 59. A material suited to the purpose is used for the ball 57, for example steel, plastic, or the like. The ball 57 is arranged in such a way that a part of its surface 60 is disposed against the front surface 5 of the paraffin body 4. Thus a stopping surface 61 is formed by the surface 60 of the ball 57, which stopping surface 61 lies on that part of the surface 60 of the ball 57 which is disposed against the paraffin body 4 during the rolling movement of the ball 57. A further ball 57' is positioned to engage the paraffin body 4, which ball 57' is arranged at a holder 59' in the same way.

In an altered embodiment (not shown), instead of two balls 57,57', a ball collar is provided, which comprises a plurality of balls, whereby the surfaces of the balls are disposed against the front surface 5 of the paraffin body 4 and thus form a plurality of stopping faces.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A device for waxing a travelling yarn, comprising:

a carrier member carrying a wax body and attached to means for rotatably driving said wax body with said driving means being independent of the frictional force between the wax body and the yarn on said wax body during waxing operation, abutting means attached to holding means of said means for rotatably driving for abutting the wax body at a front surface of said wax body protruding from said holding means, and means for resiliently pressing said wax body against said abutting means, said means for resiliently pressing located between said carrier member and said driving means, wherein said abutting means includes at least one rotatably driven abutting element which is abutting the wax body front end surface and wherein said rotatable driven abutting element is frictionally driven by said rotatable driven wax body.

2. A device according to claim 1, wherein said at least one abutting element includes a pair of rotatably driver abutting elements.

3. A device according to claim 1, wherein said at least one abutting element includes a roller with a rotational axis which intersects a rotational axis of the wax body during waxing operation.

4. A device according to claim 1, wherein said at least one abutting element includes a rotatable disk.

5. A device according to claim 1, wherein said at least one abutting element includes a rotatable ball.

6. Yarn waxing apparatus comprising a support member:

a wax body holder comprised of a carrier for holding a wax body, said carrier being mounted on a drive means mounted on a shaft for rotatable movement, said shaft being attached to said holder, a drive mechanism attached to said drive means for positively rotating said carrier independently of the frictional force between the yarn being waxed and the wax body when operated to wax yarn, an abutment member attached to said support member engaging an axial end surface of said wax body, and a resilient spring biasing said carrier and thereby said wax body against said abutment member, wherein said abutment member is frictionally rotated by engagement with the wax body during waxing operations.

7. Yarn waxing apparatus according to claim 6, wherein said abutment member is a rotatably supported member.

8. Yarn waxing apparatus according to claim 6, wherein said abutment member is a roller with a rotational axis which intersects a rotational axis of the wax body during waxing operation.

9. Yarn waxing apparatus according to claim 6, wherein said abutment member is a rotatable disk.

10. Yarn waxing apparatus according to claim 6, wherein said abutment member is a rotatable ball.

11. Yarn waxing apparatus according to claim 6, wherein two of said abutment member is provided as a pair of rotatably driven abutting members.

12. Yarn waxing apparatus according to claim 11, wherein each of the said abutment members is a respective roller with a rotational axis which intersects a rotational axis of the wax body during waxing operation.

13. Yarn waxing apparatus according to claim 11, wherein each of the said abutment members is a respective rotatable disk.

14. Yarn waxing apparatus according to claim 11, wherein each of the said abutment members is a respective rotatable ball.

15. Yarn waxing apparatus according to claim 6, wherein the abutment member is attached to said holder by way of a pivot to permit said abutment member to be swivelled away from the wax body.

16. Yarn waxing apparatus according to claim 6, wherein at least one of the wax body and the abutment member are vibration-dampened.

17. Yarn waxing apparatus according to claim 16, wherein the abutment member includes vibration damping material.

18. Yarn waxing apparatus according to claim 16, wherein the wax body holder comprises vibration-dampened material.

19. Yarn waxing apparatus according to claim 17, wherein the abutment member is secured by means of a holder which comprises vibration-damping material.

20. Yarn waxing apparatus according to claim 6, wherein the wax body holder comprises vibration-dampening material.

21. Yarn waxing apparatus according to claim 20, wherein the abutment member is attached to said holder by way of a pivot to permit said abutment member to be swivelled away from the wax body.

22. Yarn waxing apparatus according to claim 18, wherein the abutment member is attached to said holder by way of a pivot to permit said abutment member to be swivelled away from the wax body.

* * * * *